US006672899B2

(12) United States Patent
Morita et al.

(10) Patent No.: US 6,672,899 B2
(45) Date of Patent: Jan. 6, 2004

(54) ASSEMBLY OF ELECTRIC CONNECTORS

(75) Inventors: Makoto Morita, Nisshin (JP); Toshiaki Horii, Nisshin (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/190,590

(22) Filed: Jul. 9, 2002

(65) Prior Publication Data

US 2003/0017750 A1 Jan. 23, 2003

(30) Foreign Application Priority Data

Jul. 18, 2001 (JP) ..... 2001-217744

(51) Int. Cl.[7] ..... H01R 13/60
(52) U.S. Cl. ..... 439/541.1
(58) Field of Search ..... 439/79, 80, 540.1, 439/541.5, 567, 594, 595, 596, 603

(56) References Cited

U.S. PATENT DOCUMENTS 5,733,143 A 3/1998 Ward et al.
5,823,822 A * 10/1998 Tan et al. ..... 439/541.5
6,033,258 A * 3/2000 Huang et al. ..... 439/541.5
6,068,509 A * 5/2000 Lin ..... 439/541.5
6,077,114 A * 6/2000 Lu ..... 439/541.5
6,159,040 A * 12/2000 Chang et al. ..... 439/541.5
6,168,462 B1 * 1/2001 Liao ..... 439/541.5
6,179,653 B1 * 1/2001 Cheng et al. ..... 439/541.5
6,183,270 B1 * 2/2001 Huang et al. ..... 439/79

* cited by examiner

*Primary Examiner*—Lynn Feild
*Assistant Examiner*—Thanh-Tam Le
(74) *Attorney, Agent, or Firm*—Antonelli, Terry, Stout & Kraus, LLP

(57) ABSTRACT

An electric connector assembly has an upper connector (1) stacked on a lower connector (2) and having an insulated housing (4), whose opposite side-walls extend downwards to form pairs of elongate legs (5). An insulated housing (20) of the lower connector (2) also has opposite side-walls extending down to form a pair of stubby legs (21) shorter than the elongate legs (5). The lower connector (2) is detachably secured in between the elongate legs (5) so as to be nested in the upper connector (1), in such a manner that either of the upper and lower connectors (1,2) can be separated from the other so as to be used alone, although any additional supporting parts or the like is not required to stack the upper connector on the lower connector.

3 Claims, 12 Drawing Sheets

ASSEMBLY OF ELECTRIC CONNECTORS

FIELD OF THE INVENTION

The present invention relates to an assembly of electric connectors of the stacked type wherein the upper one of these connectors overlies the lower one. More particularly, the invention relates to the surface-mount type assembly of connectors each having an insulated housing and a plurality of contacts, such that each contact extending rearwards is bent down to provide a conductive tail end to be inserted in a corresponding hole formed in a printed circuit board when mounting thereon the subject assembly.

PRIOR ART

Recent sophistication of the wiring and circuits in electronic apparatuses has been making it necessary to employ certain stacked type assemblies of electric connectors. Such assemblies for incorporation into computers, copiers or the like are disclosed for example in the Japanese Patent No. 3024069 and Laying-Open Gazette No. 9-148007.

In the stacked type assembly shown in Patent No. 3024069, a discrete and additional supporting member is used to stack the upper connector on the lower one. This structure undesirably increases the number of constituent parts and its manufacture requires much time and labor. Another assembly as proposed in the Gazette No. 9-148007 employs a one-piece mold as the common housing for the pair of upper and lower connectors. Thus, it has been unable to separate one of them from the other and use either of them individually.

SUMMARY OF THE INVENTION

An object of the present invention made in view of these drawbacks is to provide a stacked type assembly such that the upper electric connector can be easily laid on and united with the lower one without aid of any additional parts, and nevertheless enabling isolation of one connector from the other to be used alone.

In order to achieve this object, an assembly proposed herein substantially consists of an upper connector and a lower connector stacked one on another, each connector comprising an insulated housing and a plurality of contacts held in place therein. The contacts in each connector have conductive tail ends that are fitted in and through a guiding support and spaced from each other. The connector assembly is however characterized in that the insulated housing of the upper connector has opposite side-walls extending downwards to form a pair of elongate legs, with the insulated housing of the lower connector also having opposite side-walls likewise extending down to form a pair of stubby legs shorter than the elongate legs. More importantly, the lower connector is detachably secured in between the elongate legs so as to be tightly nested in the upper connector, with the guiding support being detachably secured to lower ends of the elongate and/or stubby legs, in such a state that the upper and lower connectors are capable of separation from each other to be used alone.

In order to consolidate the lower connector with the upper one stacked thereon, each elongate leg of the upper connector may have a cutout opened down. Correspondingly, each stubby leg of the lower connector may have a ridge fitted in the cutout so that the insulated housings of the connectors are fixed in place relative to each other. This structure will provide a surer mutual engagement between the constituent connectors and afford a higher rigidity to the assembly.

Preferably, the guiding supports of the upper and lower connectors are formed integral with each other to provide a common support plate, so as not only to reduce the number of parts but also to further improve rigidity of this assembly.

THE PREFERRED EMBODIMENTS

Figure 1:
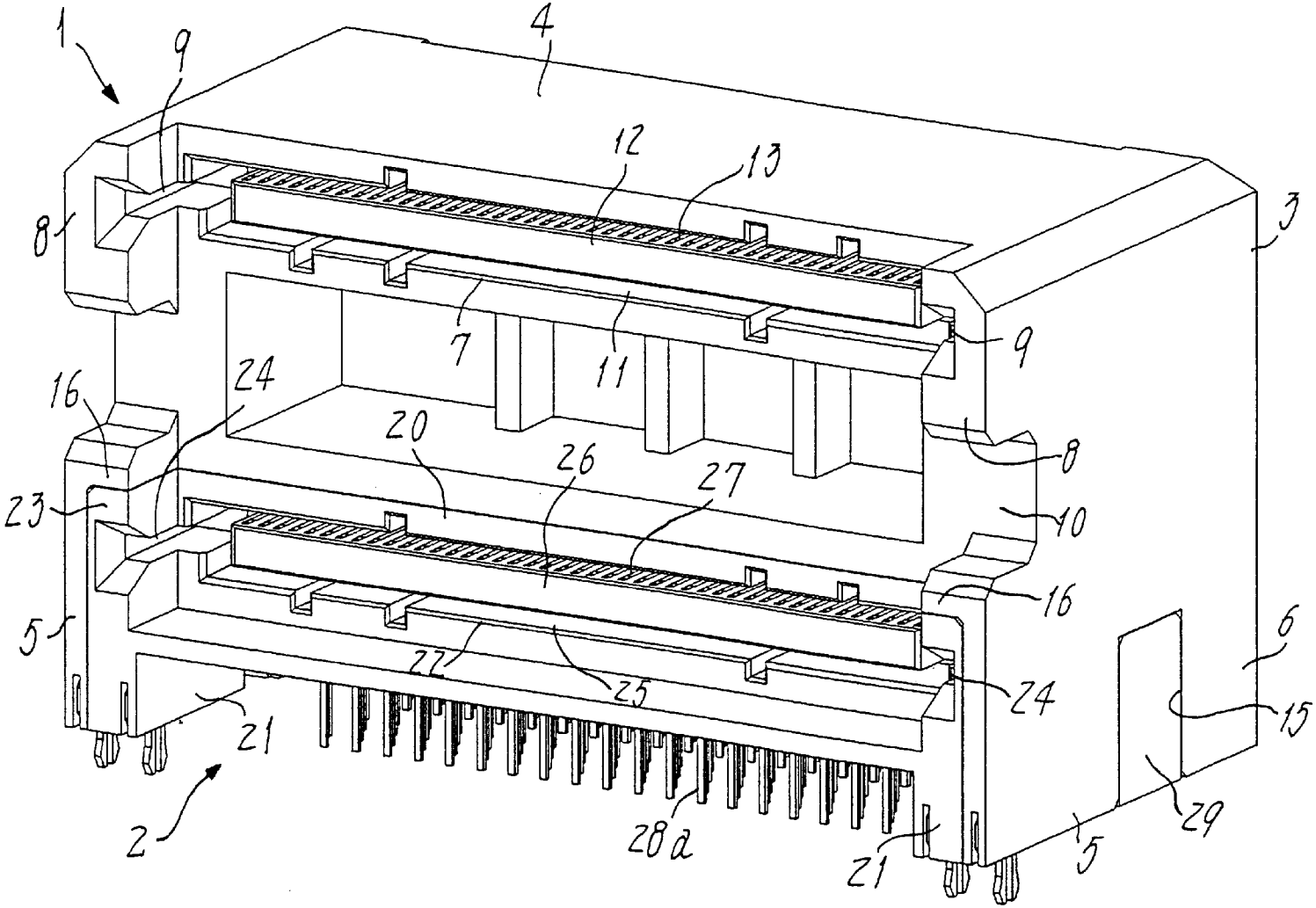
FIG. 1 is a perspective view of an assembly of electric connectors provided herein.
Figure 2:
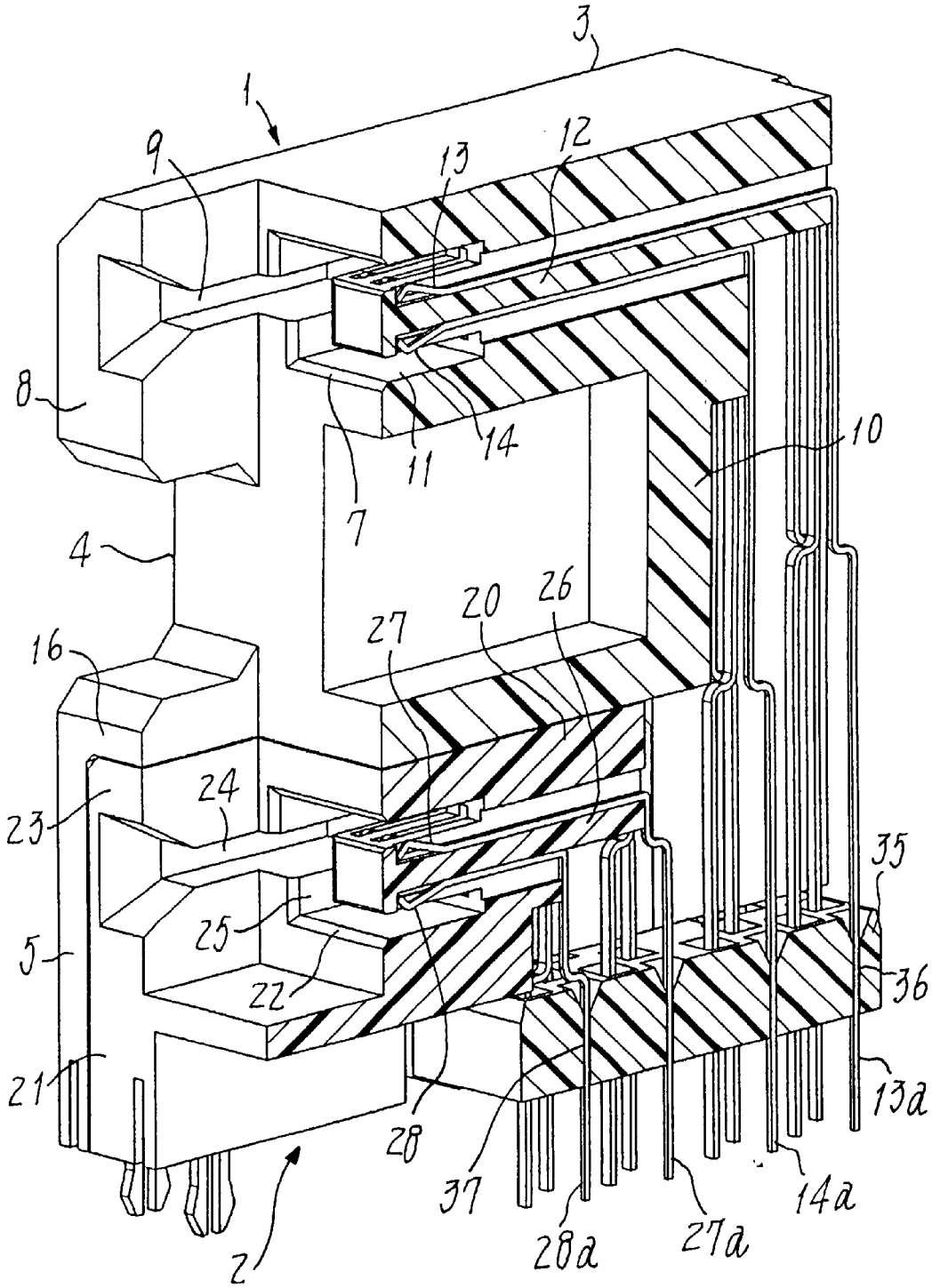
FIG. 2 is a fragmentary perspective view of the assembly, with its principal parts shown in cross section.
Figure 3:
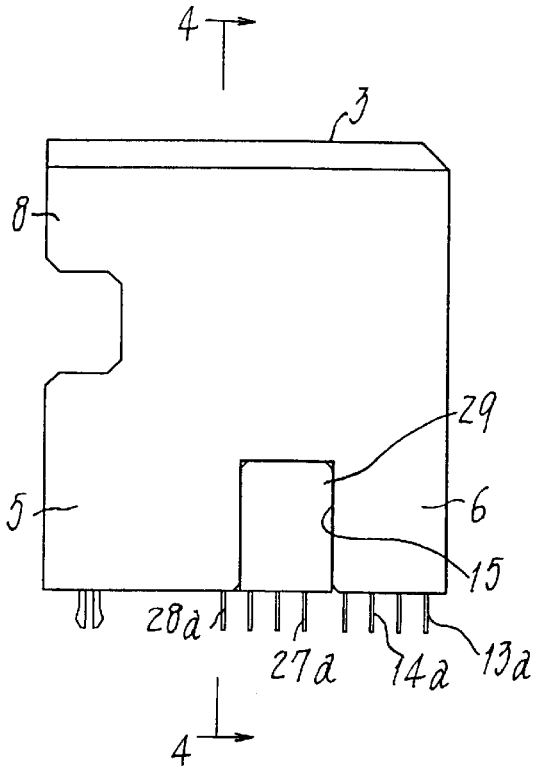
FIG. 3 is a side elevation of the connector assembly.
Figure 4:
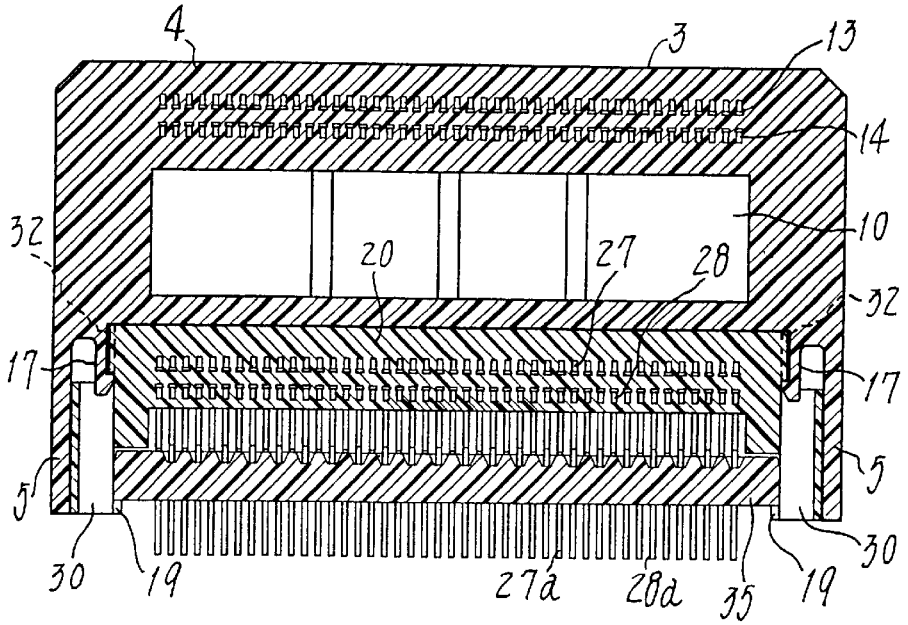
FIG. 4 is a cross section taken along the line 4—4 in FIG. 3.

Now some embodiments of the present invention will be described referring to the drawings.

FIGS. 1 to 5 illustrate an assembly of electric connectors provided herein and shown in use. This assembly comprises an upper connector 1 stacked on a lower connector 2.

The upper connector 1 includes an insulated housing 3 generally gate-shaped as seen in FIGS. 6 to 11. A body 4 of this housing 3 is a rectangular parallelepiped extended sideways and having opposite side-walls, from which a pair of elongate legs 5 and 6 continue downwards. Formed adjacent to a top of the housing body 4 is a slot 7 extending sideways to receive one of mating connectors 42 (see FIG. 5). A pair of guide walls 8 protrude from fore and upper corners of the housing body 4, and guide grooves 9 respectively formed in these guide walls 8 are in communication with lateral ends of the slot 7. Intermediate walls 10, as portions of the housing body 4 serve to position said slot 7 remote from the elongate legs 5 and 6.

Disposed from side to side in a cavity 11 as a major space of the slot 7 is a partition 12 that has an upper and lower faces, along which pluralities of plug contacts 13 and 14 are arranged respectively at regular and horizontal intervals. As will be seen best in FIG. 7, each contact 13 and 14 extends rearwardly of the housing body 4 at first, and then bent down generally at a right angle to give a conductive tail end. These tail ends 13*a* and 14*a* will be inserted in corresponding holes formed in a printed circuit board, when this connector assembly is surface mounted thereon. Each conductive tail end 13*a* and 14*a* is fitted in one of guide holes 36 that are formed in and through a guiding support (viz., locater) 35. Thus, these tail ends 13*a* and 14*a* are fixed in place at a pre-determined pitch through this locater 35, as will be discussed below.

The fore elongate leg 5 and rear elongate leg 6, both extending down from the opposite side-walls of housing body 4, define a cutout 15 between them 5 and 6. This cutout 15 engages and fixes in place a housing body 20 of the lower connector 2. Each fore elongate leg 5 made considerably thinner than the rear one 6 protrudes forwardly of the housing body 4 and has an upper end formed as a retaining shoulder 16. The lower connector housing body 20 has a pair of laterally opposed tops to be kept in place by those shoulders 16. Thus, the fore elongate legs 5 grip and hold opposite sides of the lower housing body 20 in such a state that the lower connector 2 is tightly nested in the housing 3 of upper connector 1. Resilient arms 17 depend from opposite bottom portions of the upper housing body 4. Those resilient arms 17 facing one another press side faces of the lower connector housing 20 toward each other. Such arms 17 each having a pawl 18 facing inwards are located inside and adjacent to the inner upper corners of the fore elongate legs 5 (see FIG. 10). On the other hand, the rear elongate legs 6 have, at inner faces of their lower ends, protrusions 19 formed integral therewith. These protrusions 19 hook and retain the guiding support (viz., locater) 35 (see FIGS. 9 and 10) as will be detailed below.

As shown in FIGS. 12 to 17, the housing body 20 of the lower connector 2 is also a rectangular parallelepiped extended sideways. A pair of stubby legs 21 depending from the opposite lower ends of this housing body 20 are made integral therewith. At a location retraced backwards from the fore face of housing body 20, a further slot 22 that is an opening for receiving a further mating connector 44 (see FIG. 5) extends transversely from side to side. Guide walls 23 protrude forwards from the housing body's portions adjacent to the opposite ends of this slot 22, and guide grooves 24 formed in those guide walls 23 do communicate with said ends of slot 22.

Figure 13:
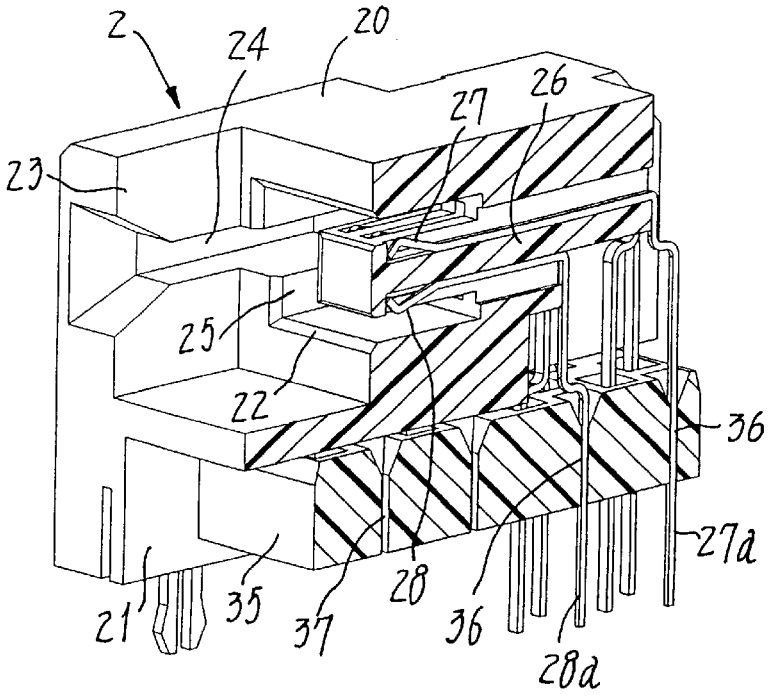
FIG. 13 is a fragmentary perspective view of the lower connector, with its principal parts shown in cross section.
Figure 14:
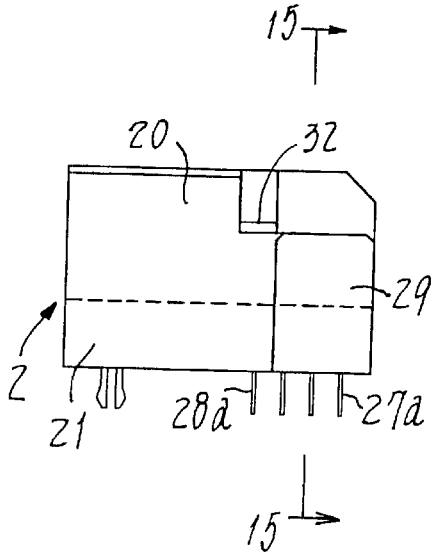
FIG. 14 is a side elevation of the lower connector.
Figure 15:
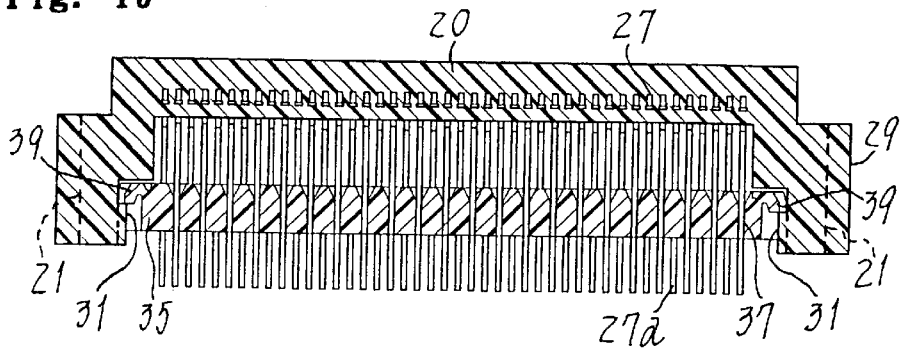
FIG. 15 is a cross section taken along the line 15—15 in FIG. 14.
Figure 16:
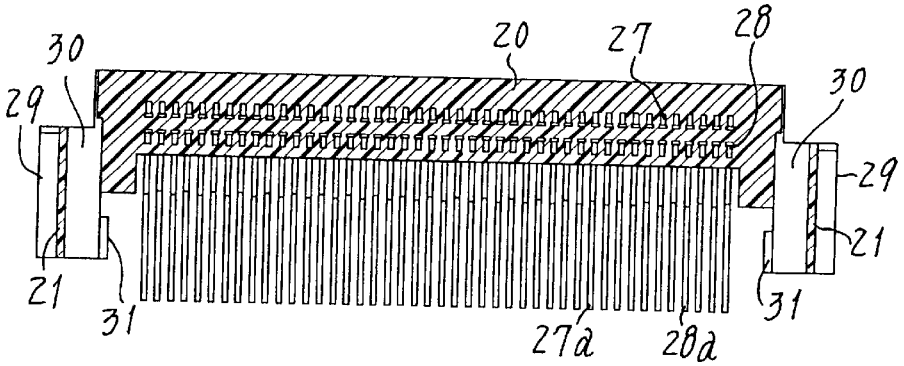
FIG. 16 is a fragmentary and cross-sectional side elevation of the lower connector from which the guiding support has been removed.

Within a cavity 25 as the major space of the further slot 22, a partition 26 is disposed similarly to the upper connector 1. An upper and lower rows of further plug contacts 27 and 28 are arranged horizontally and transversely along the upper and lower faces of said partition 26, both at a given pitch. As is shown in FIG. 13, each of the contacts 27 and 28 extends rearwardly of the housing body 20 at first, and then bent down at a right angle to give a conductive tail end 27*a* or 28*a*. These tail ends 27*a* and 28*a* will be inserted in corresponding holes formed in the aforesaid printed circuit board, when this connector assembly is surface mounted thereon. As will be detailed later, each conductive tail end 27*a* and 28*a* is fitted in one of guide holes 36 or 37 that are formed in and through the guiding support (viz., locater) 35. Thus, these tail ends 27*a* and 28*a* also are fixed in place at a predetermined pitch through this locater 35.

Rear vertical zones of the stubby legs 21 continuing from the housing body 20 have integral ridges 29 for engagement into the upper connector housing's 3 cutouts 15. Formed adjacent to these ridges 29 are through-holes 30 to receive the resilient arms 17 continuing from the opposite lower corners of upper connector housing body 4. The stubby legs 21 have, at inner faces of their lower ends, further protrusions 31 formed integral therewith. These protrusions 31 also hook and retain the aforesaid guiding support 35 (see FIG. 16). Formed integrally at upper side edges of housing body 20 are shoulders 32 to be latched with the resilient arms' pawls 18 of the upper connector 1 (see FIGS. 4 and 14).

Figure 18:
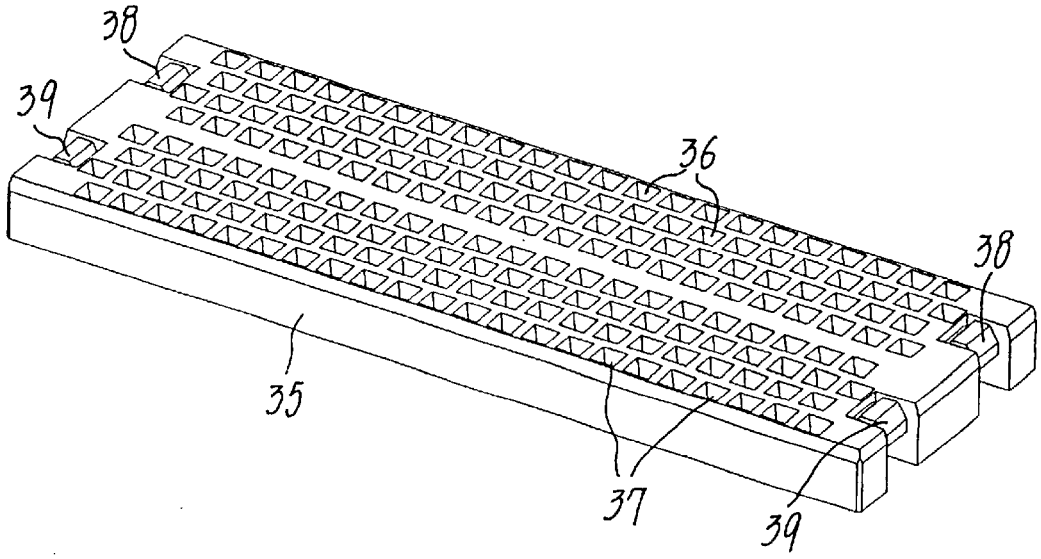
FIG. 18 is a perspective view of the guiding support.
Figure 19:
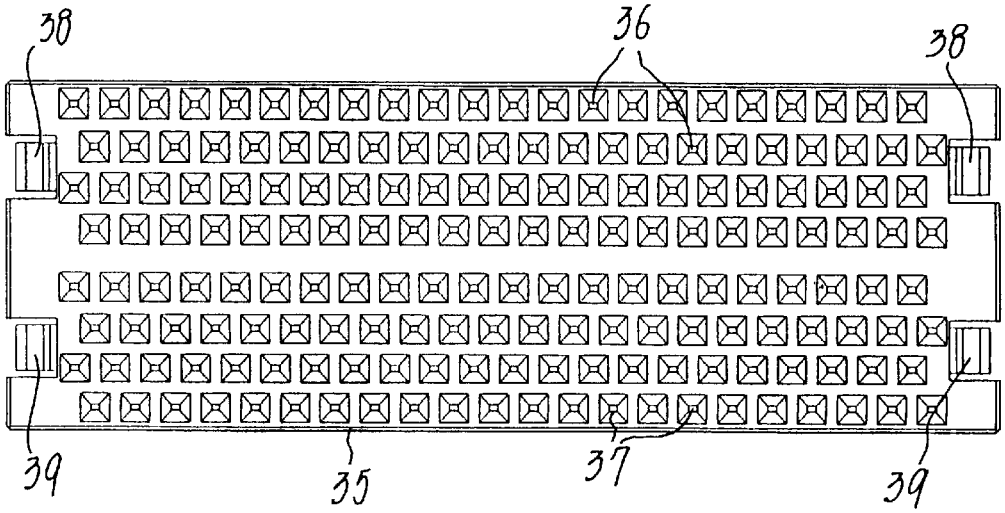
FIG. 19 is a plan view of the guiding support.

FIGS. 18 and 19 show the guiding support (viz., locater) 35 adapted to individually position and hold in place the conductive tail ends 13*a*, 14*a*, 27*a* and 28*a*. Thus these tail ends of the plug contacts 13, 14, 27 and 28 described above are isolated from each other.

In order that a one-piece member can work as both the guiding supports 35 for the upper and lower connectors 1 and 2, a single plate is used which has two groups of first guide holes 36 and second guide holes 37. Every first guide hole 36 is of the same shape as every second guide hole 37, and both the groups of guide holes 36 and 37 are arranged at the same pitch to respectively form 4 rows of a staggered pattern. Resilient pawls 38 engaging the upper connector's protrusions 19 are formed integral with such a single common support plate and at the opposite ends of its first zone where the first guide holes 36 are present. Likewise, further resilient pawls 39 engaging the lower connector's protrusions 31 are formed integral with this common support plate and at the opposite ends of its second zone where the second guide holes 37 are present.

In place of such a common support plate 35 for both the upper and lower connectors 1 and 2, two discrete guiding supports may alternatively be employed, one for the upper connector 1 and the other for the lower connector 2. However, the single common plate 35 as illustrated herein will be advantageous in that the number of constituent parts is reduced at one hand and the rigidity of connector assembly as a whole is raised on the other hand. Improvement in rigidity results from the fact that the single and common support 35 engages and reinforces both the upper and lower housing bodies 4 and 20, when the upper connector 1 is stacked on the lower connector 2 to form an assembly.

In use, the constituent parts of the upper and lower connectors 1 and 2 constructed as above will operate as follows, respectively and as whole.

Figure 5:
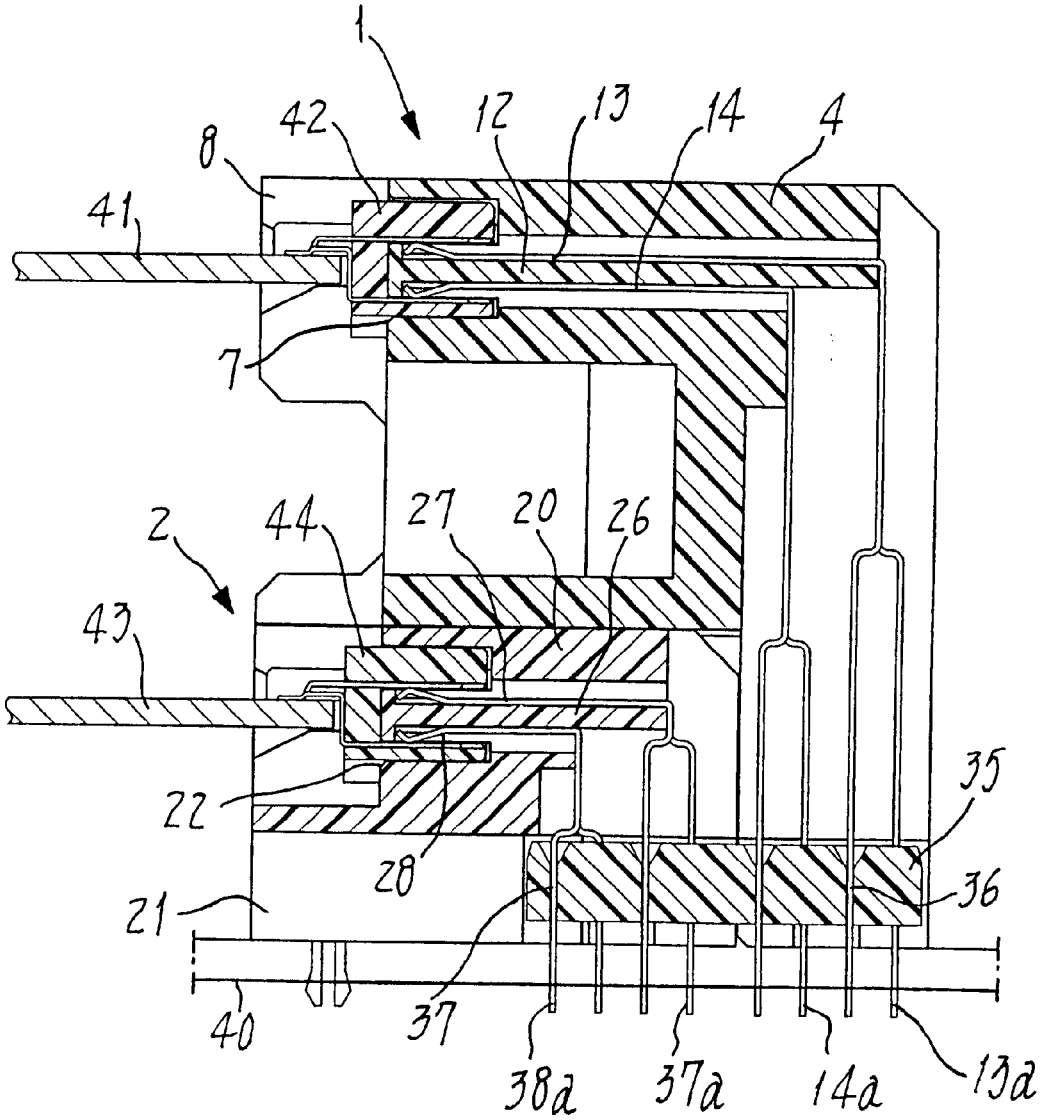
FIG. 5 is a cross-sectional side elevation of the connector assembly in use.
Figure 6:
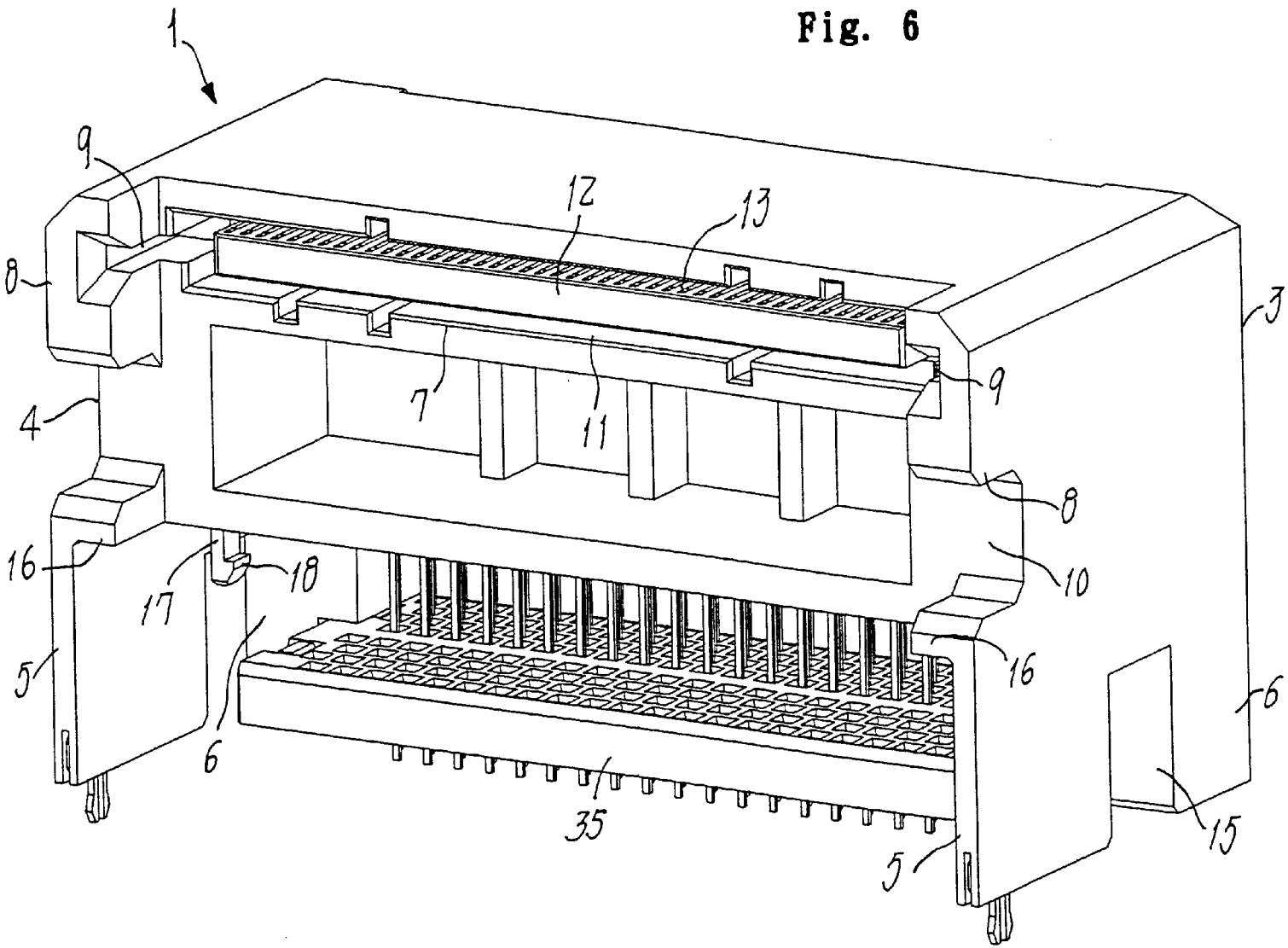
FIG. 6 is a perspective view of an upper connector included in the assembly.
Figure 7:
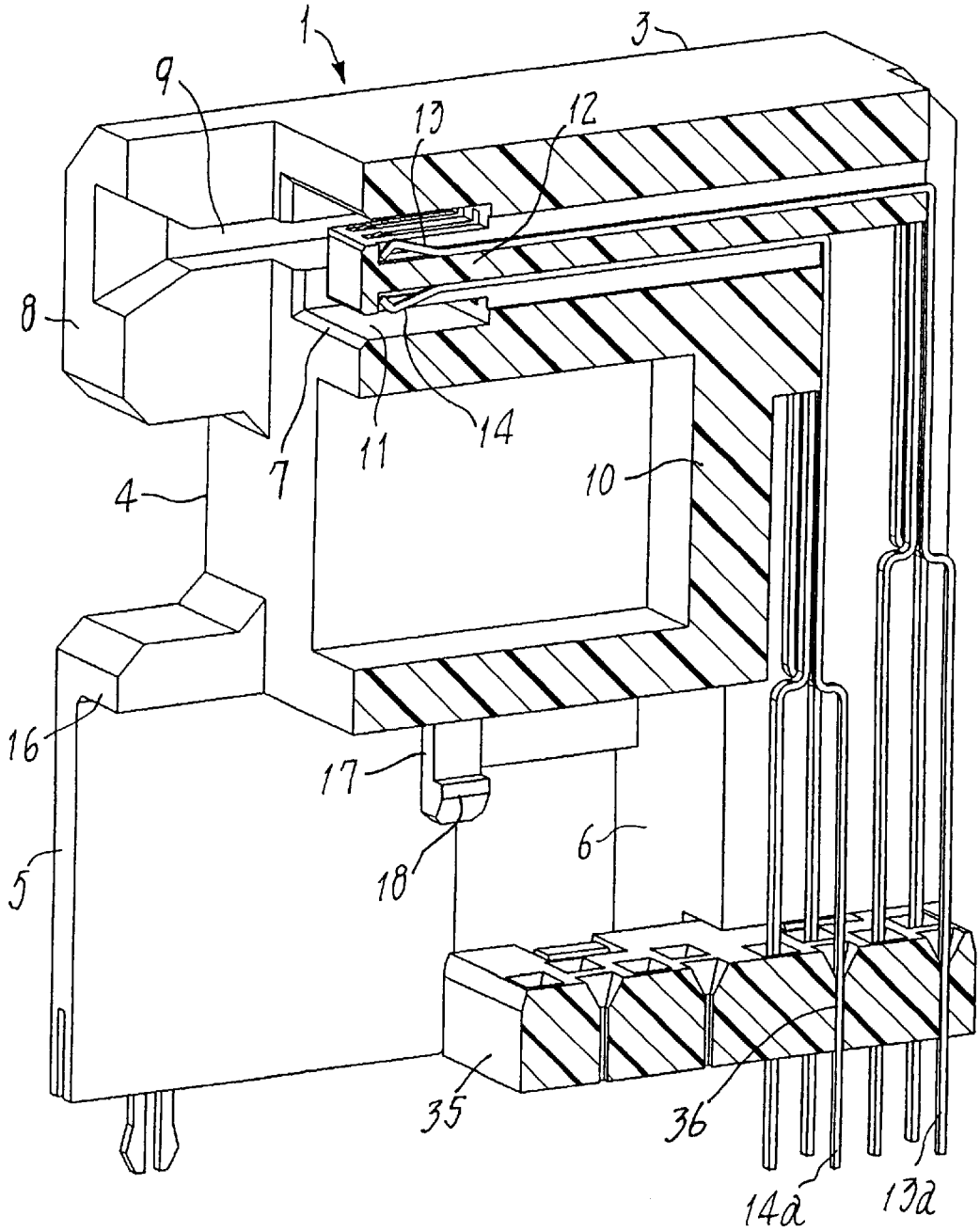
FIG. 7 is a fragmentary perspective view of the upper connector, with its principal parts shown in cross section.
Figure 8:
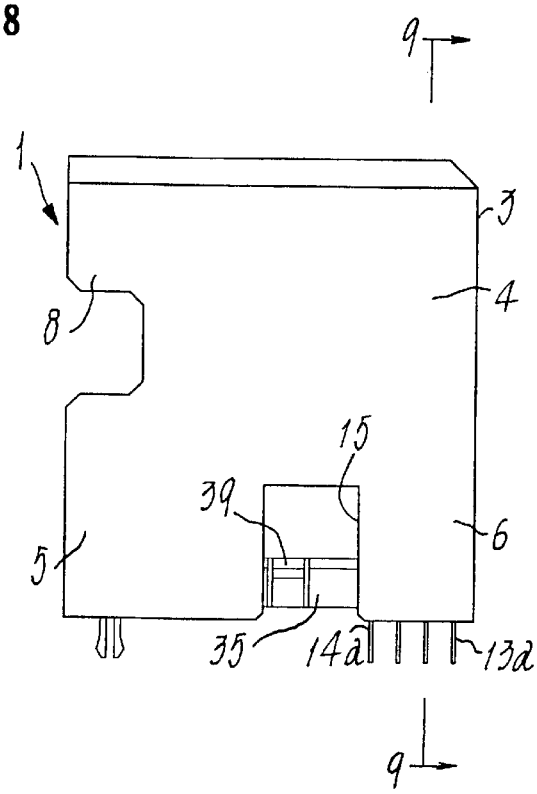
FIG. 8 is a side elevation of the upper connector.
Figure 9:
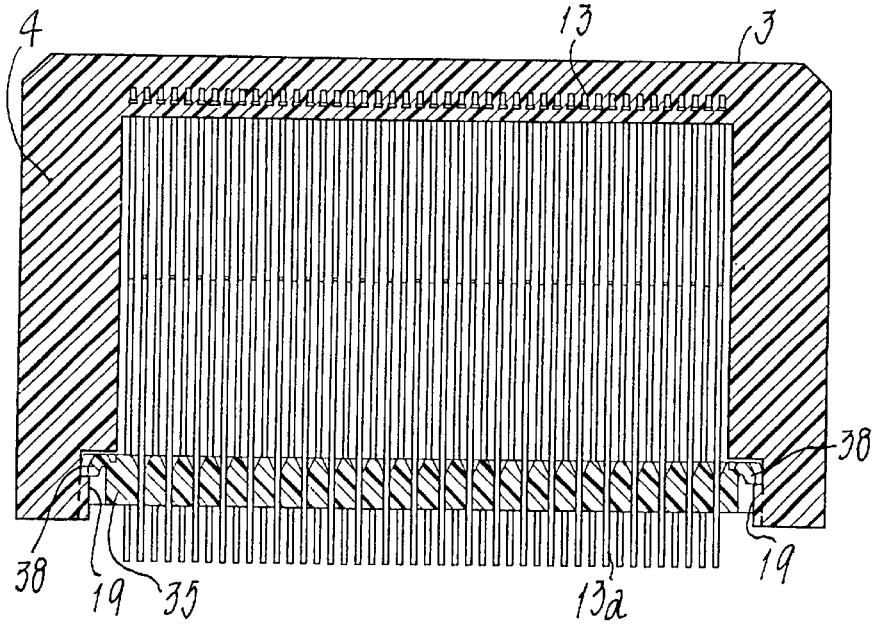
FIG. 9 is a cross section taken along the line 9—9 in FIG. 8.
Figure 10:
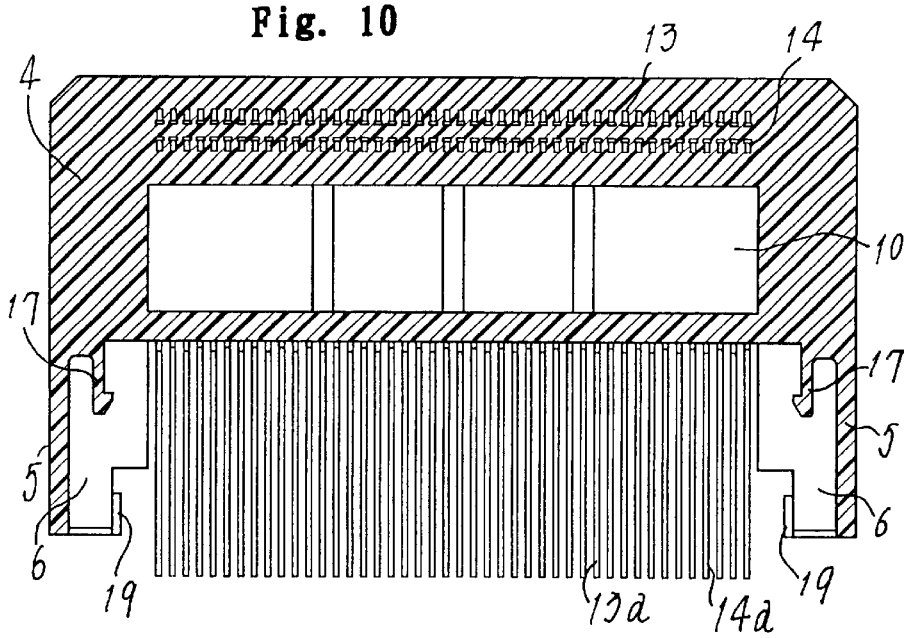
FIG. 10 is a fragmentary and cross-sectional side elevation of the upper connector from which a guiding support has been removed.

FIG. 5 shows how the stacked assembly of those connectors 1 and 2 is surface-mounted on a printed circuit board 40. As seen best in FIGS. 1 and 4, the lower connector 2 in this assembly will have its housing body 20 fitted in between the elongate legs 5 of the upper connector housing body 4. The ridges 29 on the former housing body's side-walls will thus engage with the respective cutouts 15, with the pawls 18 of resilient arms 17 catching the shoulders 32 (see FIG. 14) formed at the side-wall upper ends of the latter housing body 20, thereby consolidating these unit connectors 1 and 2. In this state, the common support 35 holding in place all the conductive tail ends 13*a*, 14*a*, 27*a* and 28*a* of plug contacts 13, 14, 27 and 28 has its first resilient pawls 38 latching the upper connector's protrusions 19, with its second resilient pawls 39 latching the lower connector's protrusions 31. This means that the common support plate 35 is in a rigid connection with both the housing bodies 4 and 20 so as to be fixedly secured therein. Thus, the upper and lower connectors 1 and 2 engaged with each other will enhance rigidity of the assembly in its entirety.

As shown in FIG. 5, a mating connector 42 attached to the edge of a card-shaped printed circuit board 41 will be put in the slot 7 of the upper connector 1 so as to establish an electric connection between these connectors 42 and 1. Previously or subsequently, another mating connector 44 attached to the edge of another similar circuit board 43 will be put in the slot 22 of the lower connector 2.

Figure 11:
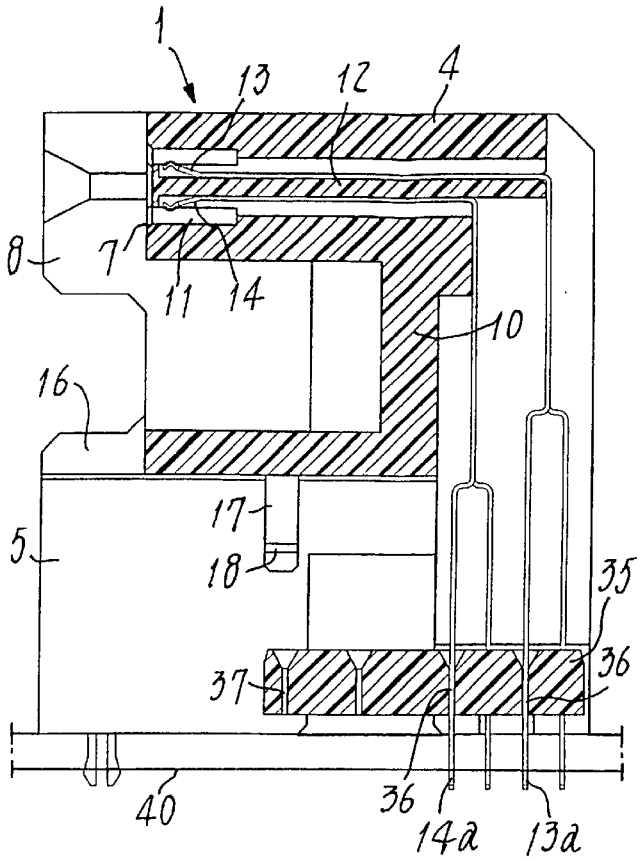
FIG. 11 is a cross-sectional side elevation of the upper connector used alone.
Figure 12:
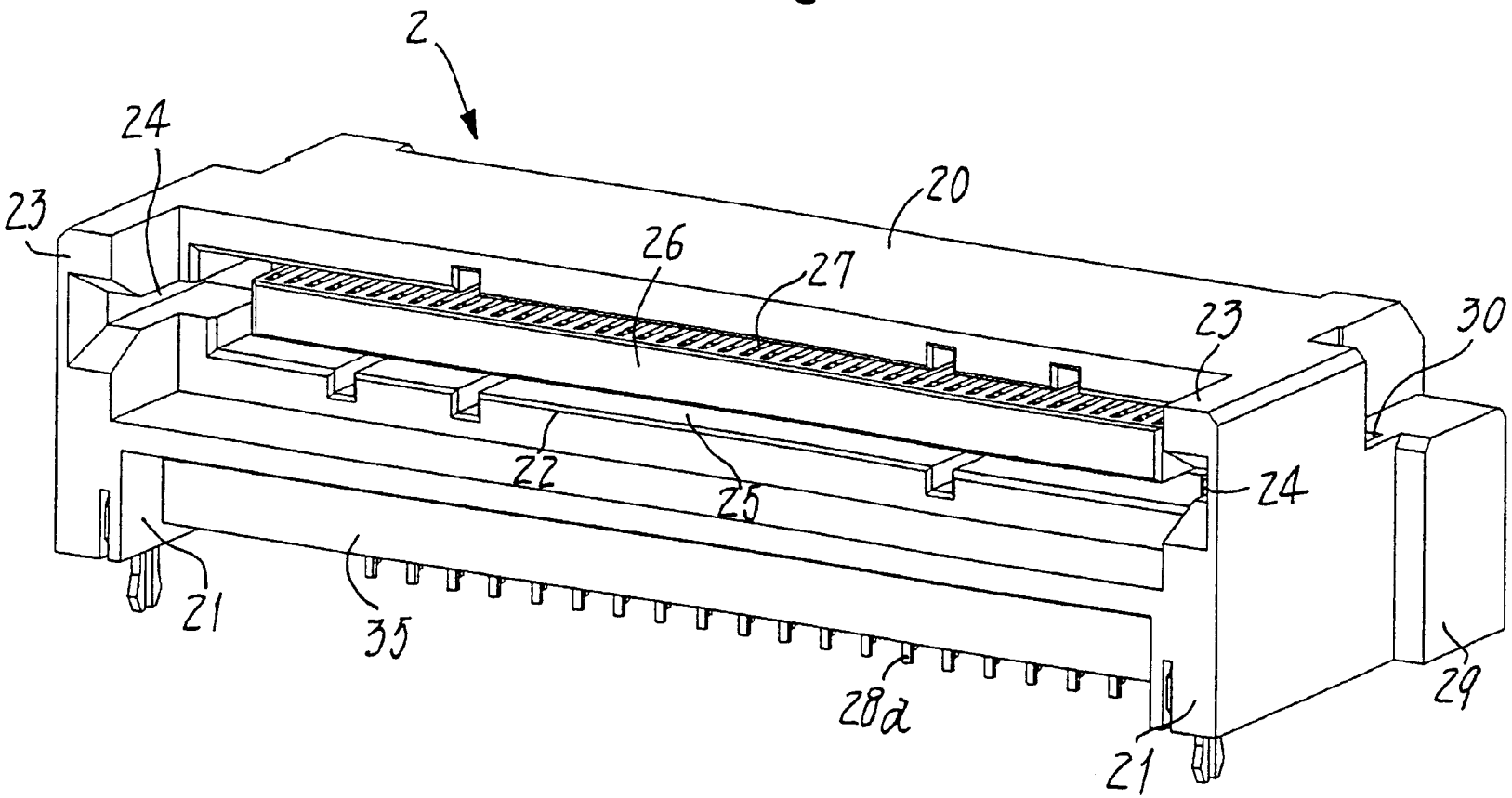
FIG. 12 is a perspective view of a lower connector included in the assembly.

FIG. 11 shows a first case of an alternative mode of using the subject connector assembly, wherein only the upper connector 1 will be surface-mounted on a different printed circuit board 40. In this case the first resilient pawls 38 of the common guiding support 35 are engaged with and secured to the protrusions 19 of the first housing body 4.

Figure 17:
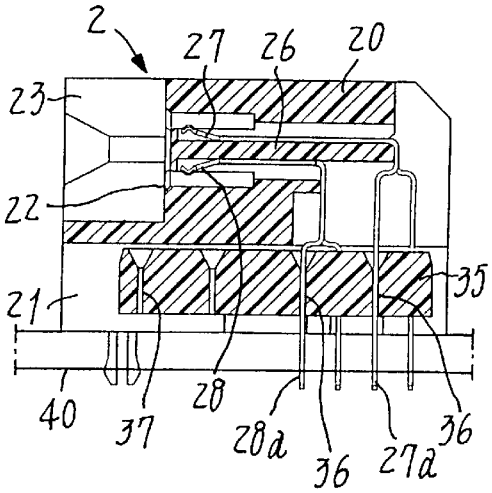
FIG. 17 is a cross-sectional side elevation of the lower connector used alone.

FIG. 17 shows a second case of the alternative mode of using the subject connector assembly, wherein only the lower connector 2 will be surface-mounted on the different printed circuit board 40. In this case, the second resilient pawls 39 of the common guiding support 35 are engaged with and secured to the protrusions 31 of the second housing body 20 (see FIG. 15). The conductive tail ends 27*a* and 28*a* of plug contacts 27 and 28 will be inserted in and guided through the corresponding holes 36.

It will now be apparent that the assembly proposed herein does not need any additional supporting parts or the like for the purpose of stacking the upper connector on the lower connector. These electric connectors can now be combined more easily to provide a more rigid assembly thereof of the stacked type.

Those unit connectors, either upper one or lower, may be used alone, thus rendering it very convenient to use or other handle the assembly.

What is claimed is:

1. An assembly of electric connectors, the connectors being an upper connector and a lower connector stacked one on another:

each connector comprising an insulated housing and a plurality of contacts held in place therein;

the contacts in each connector having conductive tail ends that are fitted in and through a guiding support and spaced from each other;

the insulated housing of the upper connector having opposite side-walls that extend downwards to form pairs of elongate legs; and the insulated housing of the lower connector having opposite side-walls that extend downwards to form a pair of stubby legs shorter than the elongate legs, wherein the lower connector is detachably secured in between the elongate legs so as to be disposed below and nested in the upper connector, with the guiding support being detachably secured to lower ends of the elongate and/or stubby legs, and the upper and lower connectors are capable of separation from each other to be used alone.

2. An assembly of electric connectors as defined in claim 1, wherein the guiding supports of the upper and lower connectors are formed integral with each other to provide a common support plate.

3. An assembly of electric connectors as defined in claim 1, wherein each elongate leg of the upper connector has a cutout opened down, and each stubby leg of the lower connector has a ridge fitted in the cutout so that the insulated housings of the connectors are fixed in place relative to each other.

* * * * *